US009068340B2

(12) United States Patent
Austin et al.

(10) Patent No.: US 9,068,340 B2
(45) Date of Patent: Jun. 30, 2015

(54) NON-BEARING MODULAR CONSTRUCTION SYSTEM

(71) Applicants: Douglas Austin, San Diego, CA (US); William Jencks, San Diego, CA (US)

(72) Inventors: Douglas Austin, San Diego, CA (US); William Jencks, San Diego, CA (US)

(73) Assignee: Pre-Form Systems LLC, San Diego, CA (US)

( * ) Notice: Subject to any disclaimer, the term of this patent is extended or adjusted under 35 U.S.C. 154(b) by 0 days.

(21) Appl. No.: 13/668,008

(22) Filed: Nov. 2, 2012

(65) Prior Publication Data

US 2013/0152485 A1 Jun. 20, 2013

Related U.S. Application Data

(60) Provisional application No. 61/561,750, filed on Nov. 18, 2011.

(51) Int. Cl.

| | |
|---|---|
| ***E04G 21/00*** | (2006.01) |
| ***E04H 7/00*** | (2006.01) |
| ***E04B 1/348*** | (2006.01) |
| ***E04B 1/16*** | (2006.01) |

(52) U.S. Cl.

CPC . *E04B 1/348* (2013.01); *E04B 1/16* (2013.01); *E04B 1/165* (2013.01); *E04B 1/34869* (2013.01)

(58) Field of Classification Search

CPC ..... E04B 1/34807; E04B 1/19; E04B 1/20; E04B 1/22; E04B 7/10

USPC ..... 52/745.03, 79.2, 79.3, 79.12, 79.14

See application file for complete search history.

(56) References Cited

U.S. PATENT DOCUMENTS

| | | | | | |
|---|---|---|---|---|---|
| 3,292,327 | A | * | 12/1966 | Van Der Lely | 52/79.13 |
| 3,331,170 | A | * | 7/1967 | Lowe et al. | 52/79.11 |
| 3,500,595 | A | * | 3/1970 | Bennett | 52/79.13 |
| 3,510,997 | A | * | 5/1970 | Ratych | 52/79.2 |
| 3,514,910 | A | * | 6/1970 | Comm | 52/79.11 |
| 3,616,592 | A | * | 11/1971 | Rothman | 52/705 |
| 3,703,058 | A | * | 11/1972 | Klett et al. | 52/79.13 |
| 3,712,008 | A | * | 1/1973 | Georgiev et al. | 52/79.12 |
| 3,751,864 | A | * | 8/1973 | Berger et al. | 52/79.11 |
| 3,758,998 | A | * | 9/1973 | Ollis et al. | 52/79.13 |
| 3,762,115 | A | * | 10/1973 | McCaul et al. | 52/236.6 |
| 3,902,287 | A | * | 9/1975 | Livingston | 52/73 |

(Continued)

OTHER PUBLICATIONS

Ouroussoff, Nicolai, Designed to Help Uplift the Poor, Feb. 18, 2010, The New York Times, p. 1-7.*

(Continued)

*Primary Examiner* — Elizabeth A Plummer

(74) *Attorney, Agent, or Firm* — Donald L. Wenskay

(57) ABSTRACT

Methods and apparatus facilitate the construction of a building using prefabricated building units, each having a horizontal upper exterior surface and a plurality of vertical wall surfaces, wherein at least some of the prefabricated building units have at least one hollow column formwork structure. The prefabricated building units are lowered onto a pre-existing base at a construction site. A first story of the building is created by arranging a plurality of the prefabricated building units adjacent to each other on the base. Structural bearing material is applied to fill the hollow column formwork structures to create structural columns connected to the structural deck. Structural bearing material is applied to the horizontal upper exterior surfaces of the adjacent prefabricated building units to create a single structural deck over the prefabricated building units.

19 Claims, 10 Drawing Sheets

(56) References Cited

U.S. PATENT DOCUMENTS

| | | | | |
|---|---|---|---|---|
| 3,975,873 | A * | 8/1976 | van der Lely | 52/79.7 |
| 3,991,528 | A * | 11/1976 | Dillon | 52/79.9 |
| 4,045,937 | A * | 9/1977 | Stucky | 52/745.03 |
| 4,078,345 | A * | 3/1978 | Piazzalunga | 52/79.13 |
| 4,107,886 | A * | 8/1978 | Ray et al. | 52/79.11 |
| 4,282,690 | A * | 8/1981 | Meheen | 52/79.11 |
| 4,525,975 | A * | 7/1985 | McWethy | 52/745.03 |
| 6,826,879 | B1 * | 12/2004 | Allen et al. | 52/236.3 |
| 7,596,909 | B1 * | 10/2009 | Gillen | 52/79.1 |
| 8,499,527 | B2 * | 8/2013 | Kobayashi et al. | 52/745.2 |
| 2010/0058675 | A1 * | 3/2010 | Simmons | 52/79.1 |
| 2011/0296789 | A1 * | 12/2011 | Collins et al. | 52/741.4 |
| 2012/0168263 | A1 * | 7/2012 | Alois | 187/408 |
| 2012/0240482 | A1 * | 9/2012 | Pitt et al. | 52/122.1 |

OTHER PUBLICATIONS

Gluck, Marissa, Ambitious Prefab Projects Underway on Both US Coasts, Dec. 20, 2012, Architectural Record, p. 1-2.*

* cited by examiner

NON-BEARING MODULAR CONSTRUCTION SYSTEM

RELATED APPLICATIONS

This application claims priority from U.S. provisional patent application No. 61/561,750 filed on Nov. 18, 2011, which is incorporated herein by reference in its entirety for all purposes.

FIELD OF INVENTION

The present invention generally relates to the field of modular building construction systems. More particularly, the disclosed embodiments relate to a system and method of assembly for prefabricated modular building units used in combination with traditional methods and materials of construction to construct noncombustible buildings of any possible height up to the limits imposed by building codes, including high-rise buildings.

BACKGROUND

The typical cost of construction for high rise buildings is inflated by the cost of onsite labor, particularly when onsite labor intensive tasks are performed higher and higher above ground level. As construction activities move up a tall building, labor rates increase and production becomes less efficient for a number of reasons including the necessity of moving project materials by crane or elevator to get the materials to their final installation location. At higher elevations, movement of both materials and labor slows down, increasing construction schedule times and again adding to the construction cost.

As areas urbanize higher density and increased land cost make high-rise buildings a necessity. Higher density also provides higher value to communities and to the environment. It reduces resource use by limiting vehicle trips and reduces development footprints to leave more undisturbed natural land elsewhere in the city or outside of city limits.

Unfortunately in many economic climates high rise building has become unfeasible due to the high cost of this building type. Since income from building operations is solely reliant upon economic conditions, the only way to make this building type viable in many situations is to reduce the cost of construction. Since the construction costs related to conventional methods of construction are also solely reliant upon economic conditions, the construction cost may be reduced by replacing some of the onsite work with prefabricated factory work, and also by reducing the total onsite construction time.

SUMMARY OF THE INVENTION

This section is intended to provide a summary of certain exemplary embodiments and is not intended to limit the scope of the embodiments that are disclosed in this application.

The disclosed embodiments include a building comprising a plurality of prefabricated building units, each having a horizontal upper surface, and a plurality of vertical wall surfaces, wherein some of the prefabricated building units include a plurality of vertically disposed formwork structures; a structural deck composed of structural bearing material disposed on said horizontal upper exterior surface and using said horizontal upper exterior surface as permanent formwork; and a plurality of vertically disposed structural elements each formed within one of said vertically disposed formwork structures.

One aspect of the disclosed embodiments relates to a method of constructing a building that includes: constructing a plurality of prefabricated building units, each having a horizontal upper exterior surface and a plurality of vertical wall surfaces, wherein at least some of the prefabricated building units have a plurality of vertically disposed formwork structures; lowering a plurality of the prefabricated building units onto a pre-existing base at a construction site to create a first story of the building; applying structural bearing material to fill the vertically disposed formwork structures to create vertically disposed structural elements; and applying structural bearing material to the horizontal upper exterior surfaces of the prefabricated building units to create a single structural deck over the prefabricated building units.

These and other advantages and features of disclosed embodiments, together with the organization and manner of operation thereof, will become apparent from the following detailed description when taken in conjunction with the accompanying drawings.

BRIEF DESCRIPTION OF THE DRAWINGS

The disclosed embodiments are described by reference to the attached drawings, in which.

DETAILED DESCRIPTION OF CERTAIN EMBODIMENTS

Figure 1:
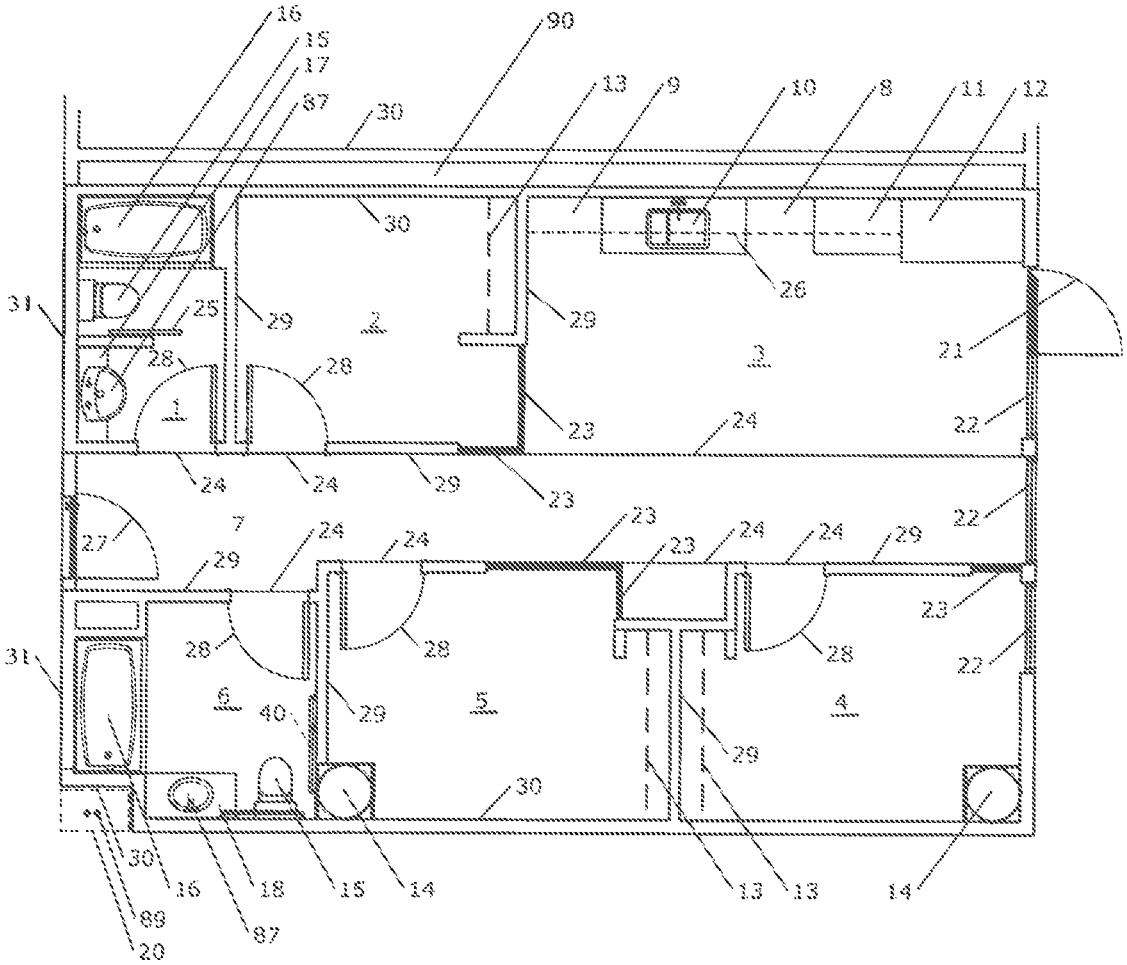
FIG. 1 illustrates a top view floor plan of a three bedroom residential unit configured as a combination of two full-width modules with a reduced-width filler section sandwiched between the full-width modules in accordance with an example embodiment.
Figure 2:
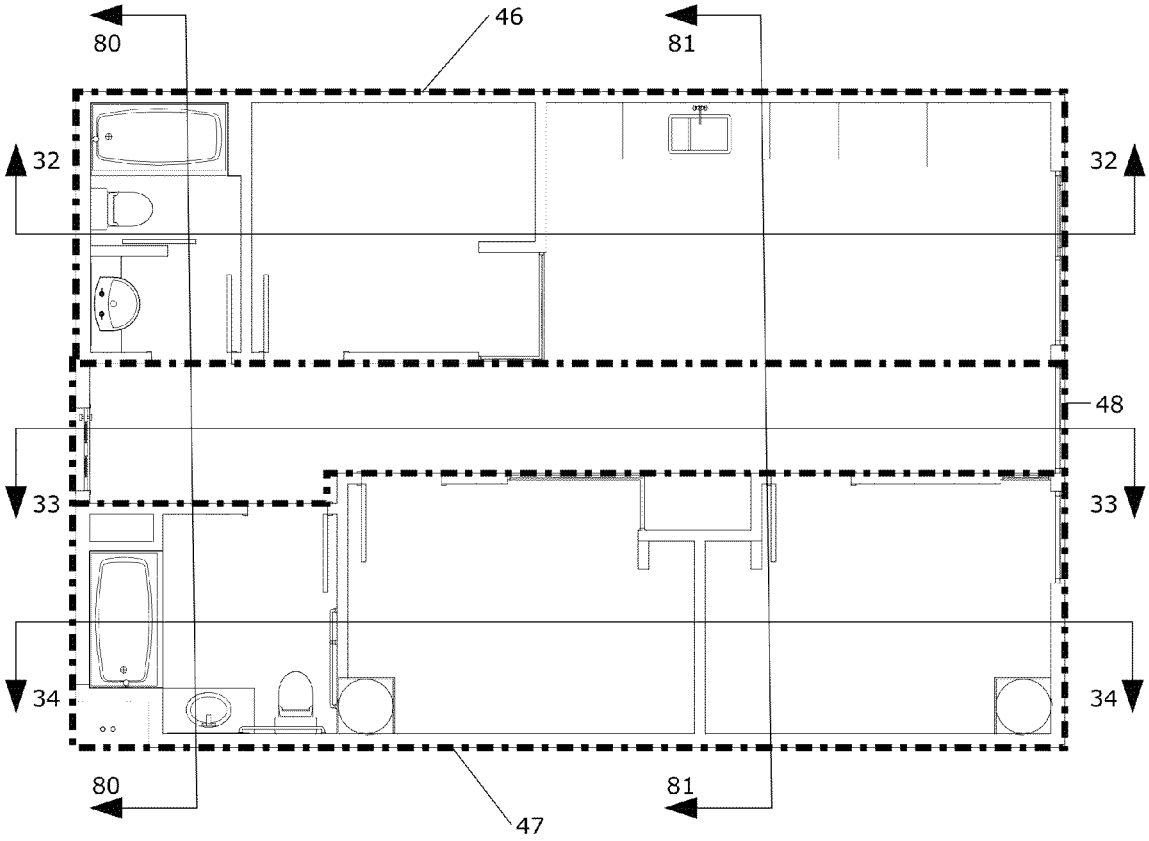
FIG. 2 illustrates a top view floor plan of the three bedroom residential unit shown in FIG. 1 illustrating the extents of each individual module in accordance with an example embodiment.

In the following description, for purposes of description and not limitation, details and descriptions are set forth in order to provide a thorough understanding of the disclosed embodiments. However, it will be apparent to those skilled in the art that the present invention may be practiced in other embodiments that depart from these details and descriptions.

Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word exemplary is intended to present concepts in a concrete manner.

Prior modular construction systems are often flawed in that they rely too heavily on complicated and largely unproven structural systems rather than integrating with conventional construction, which generally results in too rigid a system that cannot meet flexible market demands.

The present invention overcomes the drawbacks of known modular construction systems by providing non-bearing prefabricated modules, for use in the assembly of multi-story residential and other structures. The non-bearing prefabricated modules can be easily transported by standard shipping methods and, when assembled on a building site, can act as permanent formwork for concrete or another structural bearing material which provides the majority of the permanent structural integrity for the building.

One defining feature of the present invention is the fact that the modular units are completely non-bearing in the final assembly. The structural integrity of the modular units is only critical during transportation of the units and temporarily during construction. The permanent structural integrity of the final building is substantially reliant upon conventional reinforced concrete or another conventional building material.

The other defining feature is the fact that the construction of the modular units is substantially completed in the factory with paint/wall finishes, plumbing, fixtures, electrical wiring and outlets, cabinetry, and HVAC ducting and equipment pre-installed. This minimizes the need for on-site work.

Referring now to the invention in more detail, in FIG. 1, FIG. 2, FIG. 6, FIG. 7, FIG. 8, FIG. 9, FIG. 10, and FIG. 11 there is shown an exemplary complete residential living unit suitable for apartment or dormitory use, composed of three prefabricated construction modules: a bath/bed/kitchen module 46 with a bathroom 1, a bedroom 2, and a kitchen/living area 3; a hallway module 48 with a hallway 7; and a bath/two-bed module 47 with an Americans with Disability Act (ADA) compliant bathroom 6, a bedroom 4 and another bedroom 5. The modules are substantially assembled in a factory under controlled conditions and joined together along the seams 24 on-site. All three modules 46, 47 and 48 are comprised of a combination of the same components: a high strength, minimal depth flooring substrate 45 with installed floor finish 50, internal walls 29, demising walls 30, egress hallway walls 31, exterior glazing 22 with optional exterior door 21, entry door 27, interior doors 28, sliding door 25, interior glazing 23, hollow column formwork 14, a ceiling 56 or drop ceiling 58, and light weight deck 41.

All fixtures, cabinetry, or millwork are installed in the factory including kitchen cabinets 59, countertop 11, washer/dryer cabinet 86 and countertop 12, upper cabinets 26, lavatory cabinet 17, ADA compliant lavatory base 18, ADA compliant grab bars 40, and closet rods/shelves 13. All plumbing fixtures are installed in the factory including toilets 15, bathtubs 16, lavatories 87, shower fixtures 54, and sink 10. Fixed appliances such as the microwave 57 are installed in the factory while free-standing appliances may be installed in the factory if possible or may be installed conventionally on-site. Space 9 is left for a refrigerator and space 8 is left for a freestanding range/oven. All electrical wiring and outlets are installed in the factory and routed to the service shaft 20. Fixed lighting such as the bathroom lights 62 are installed in the factory. All interior finishes including the floor finish 50, tile 55, ceiling 56, dropped ceiling 58, mirrors 61 and all wall finishes are installed in the factory. All water and waste piping is installed in the factory and routed to the service shaft 20 or opposing demising wall 30. HVAC equipment such as a heat pump 44, distribution ducting 37, ventilation ducting 35, and wall vents 60 are installed in the factory and any necessary supply piping 53 or connection point is routed to the service shaft 20 for connection on site. While the embodiments described herein enable nearly all of the fixtures, electrical, plumbing, and finishing to be performed in the factory, in some situations it may be desirable to perform some of these on-site, for example, where certain kinds of customization of the units is desired. The vertically disposed structural elements (poured into the hollow column formwork 14 and structural wall cavity 90) and the structural deck 49 are poured onsite after the modules have been placed in their final position and reinforcing bar has been set.

In more detail, still referring to the invention of FIG. 1, FIG. 2, FIG. 6, FIG. 7, FIG. 8, FIG. 9, FIG. 10, and FIG. 11, the three modules 46, 47, and 48 combine to create one functional and complete living unit and provide permanent formwork for structural bearing material which is poured on site and forms the final complete structure for a building.

In further detail, still referring to the invention of FIG. 1, FIG. 2, FIG. 6, FIG. 7, FIG. 8, FIG. 9, FIG. 10, and FIG. 11, the modules 46, 47, and 48 may be sized and constructed so that each completed module may accommodate standard shipping dimensions by truck including adherence to highway regulations and standard trailer dimensions. The modules may also be of such dimension that they appropriately accommodate their final use. The living room 3 and bedrooms 2, 4, and 5 may reasonably accommodate expected furniture, bathroom 1 may accommodate plumbing fixtures with reasonable clearance for circumambulation, and if the modules are to be used in a building which requires full accessibility under the Americans with Disabilities Act (ADA) then bathroom 6 must accommodate all plumbing fixtures as well as necessary space for human movement as required by the ADA. Interior glazing 23 should provide light and views to the bedrooms 2, 4, and 5 but not be so large as to encroach on the privacy of the occupants. All walls should be sized and constructed as conventionally required for interior structural integrity and required fire resistance, which varies depending on the location of the wall and size of total building in which the module is to be used. HVAC distribution ducting 37 and ventilation ducting 35 should be sized by a mechanical engineer to accommodate the necessary heating/cooling/ventilation loads. All other fixtures and finishes and equipment should be of a size and quality appropriate to the final use of the module by conventional standards.

The construction details of the invention as shown in FIG. 1, FIG. 2, FIG. 6, FIG. 7, FIG. 8, FIG. 9, FIG. 10, and FIG. 11 are that the structure of walls 29, 30, and 31, doors 28 and 27, cabinetry, lightweight deck 41, column formwork 14, and floor substrate 45 may be of wood, metal, or any other sufficiently strong material such as high-strength plastic, fiberglass or carbon fiber as is suited to the use. In addition, exterior walls should incorporate materials that are appropriate to their exposure to the elements. Wall finishes such as tile 55, paint or wall covering must be flexible and durable enough to withstand unusual stresses from transportation prior to placement, as well as normal wear and tear during regular use after they are placed in the final building. All materials, fixtures, finishes, and equipment are to be installed such that they meet all necessary building codes, inspections, and other regulatory requirements.

Figure 3:
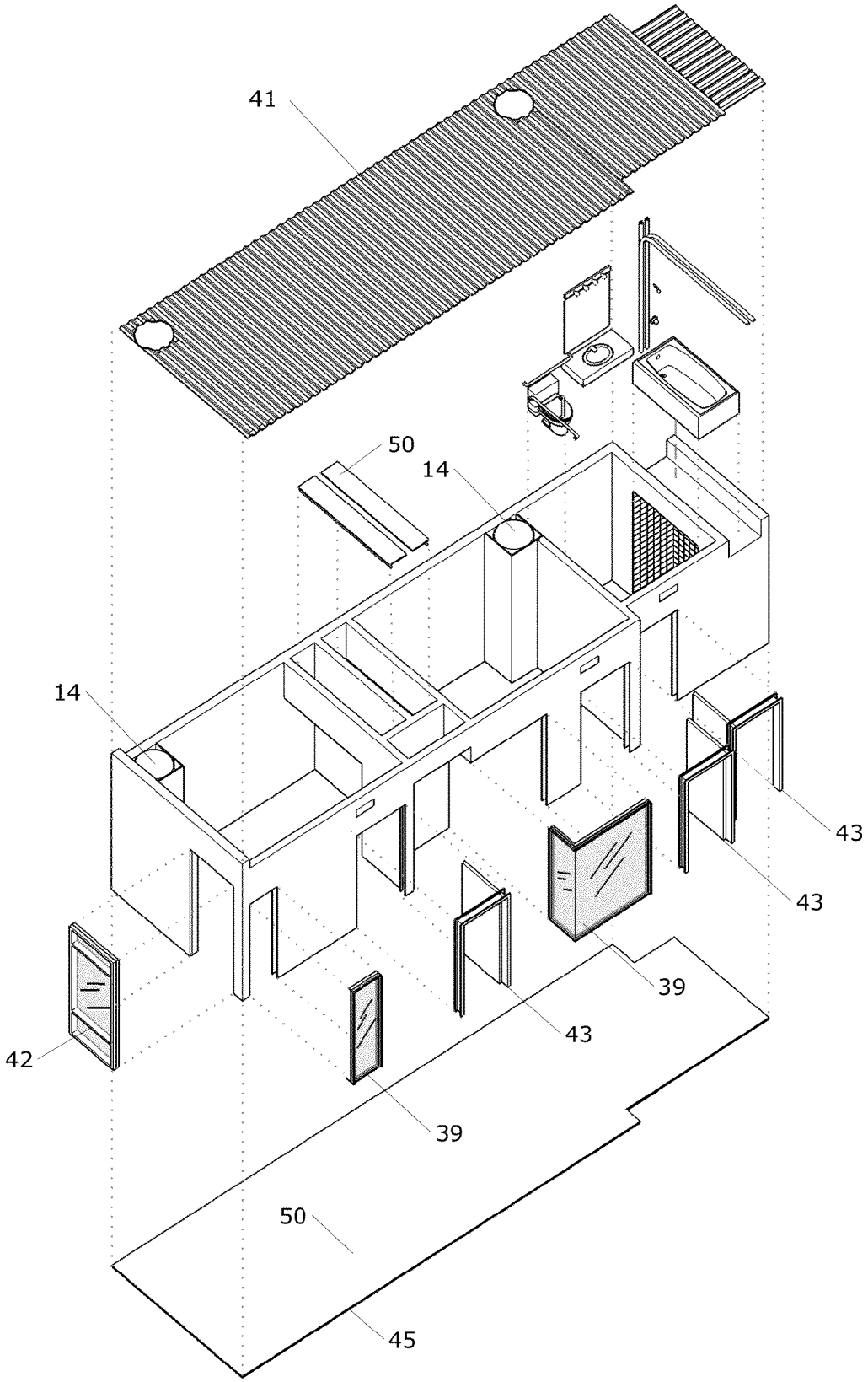
FIG. 3 illustrates an exploded axonometric view of one full-width module containing two bedrooms and an ADA-compliant bathroom in accordance with an example embodiment.
Figure 4:
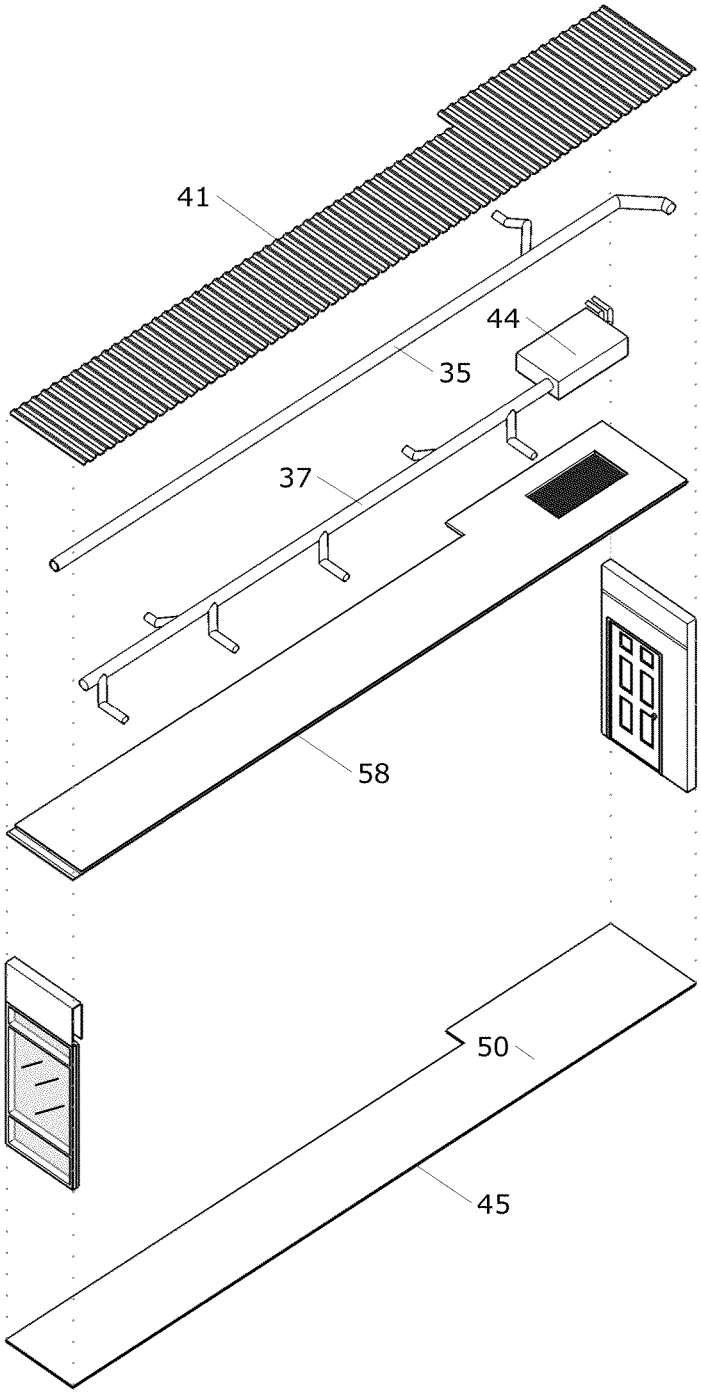
FIG. 4 illustrates an exploded axonometric view of one reduced-width filler section containing an entry door, exterior glazing, hallway, and HVAC distribution in accordance with an example embodiment.
Figure 5:
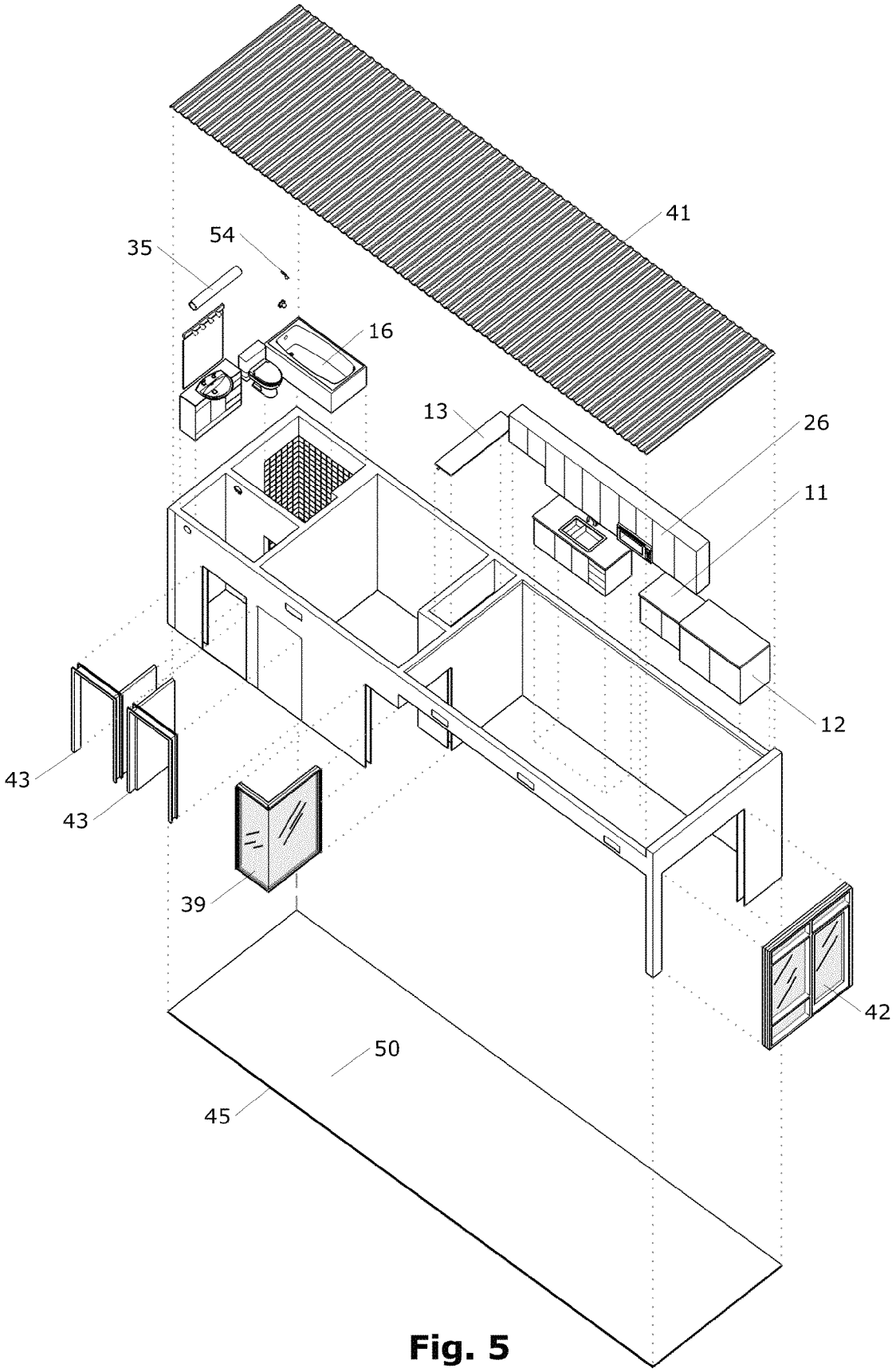
FIG. 5 illustrates an exploded axonometric view of one full-width module containing one bathroom, one bedroom, and one kitchen/living area in accordance with an example embodiment.
Figure 6:
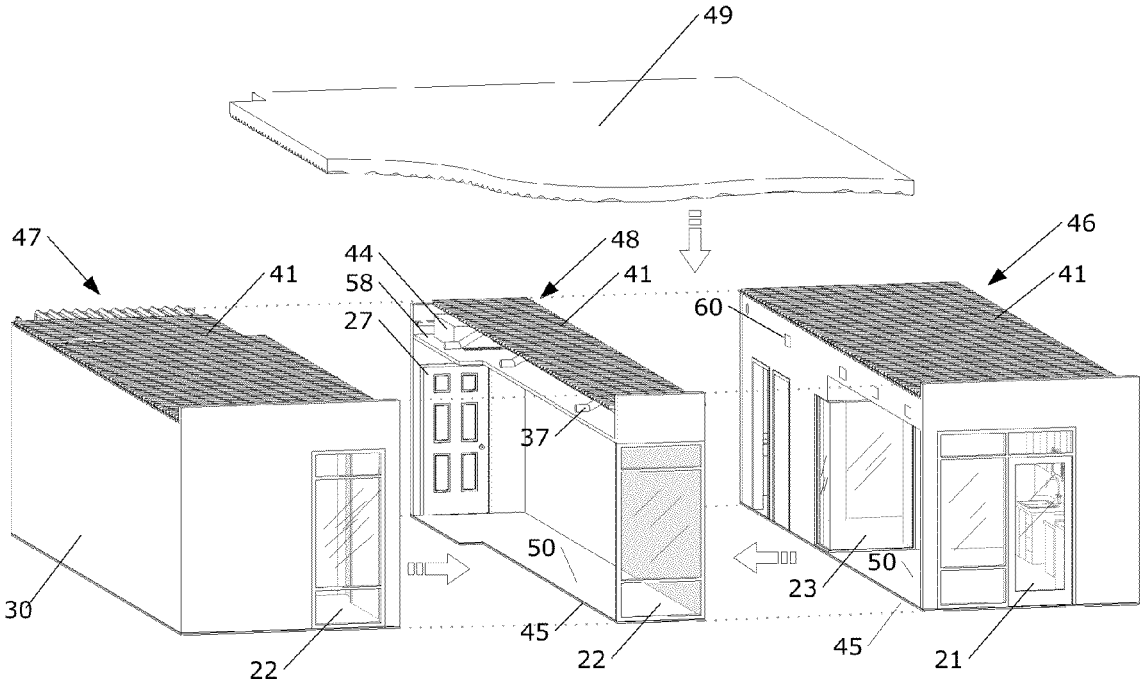
FIG. 6 illustrates an exploded axonometric view of a three bedroom residential unit composed of the three modules shown in FIGS. 1-5 in accordance with an example embodiment.
Figure 7:
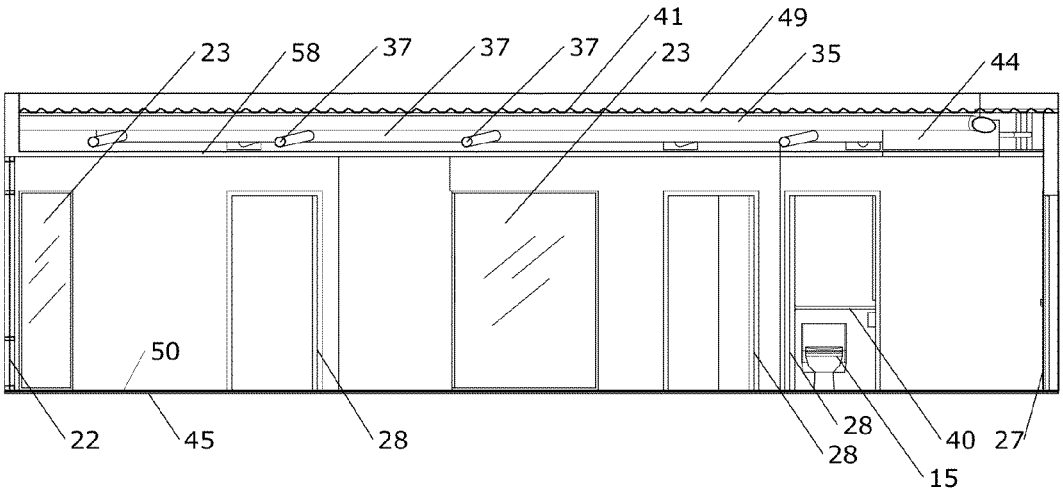
FIG. 7 illustrates is a side sectional view through the three bedroom residential unit shown in FIG. 2 as denoted by the section line 33 in accordance with an example embodiment.
Figure 8:
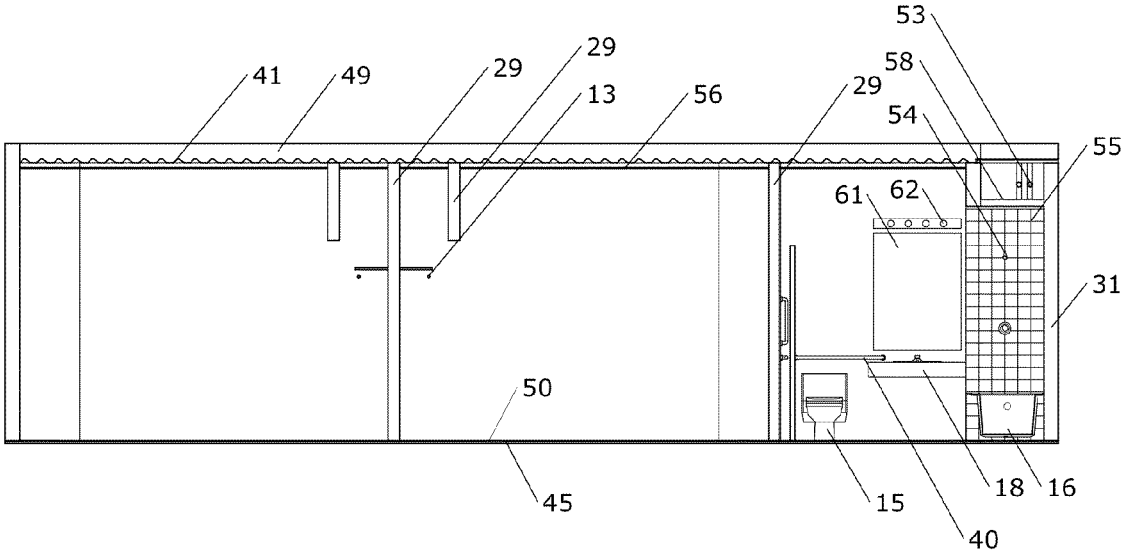
FIG. 8 illustrates a side sectional view through the three bedroom residential unit shown in FIG. 2 as denoted by the section line 34 in accordance with an example embodiment.
Figure 9:
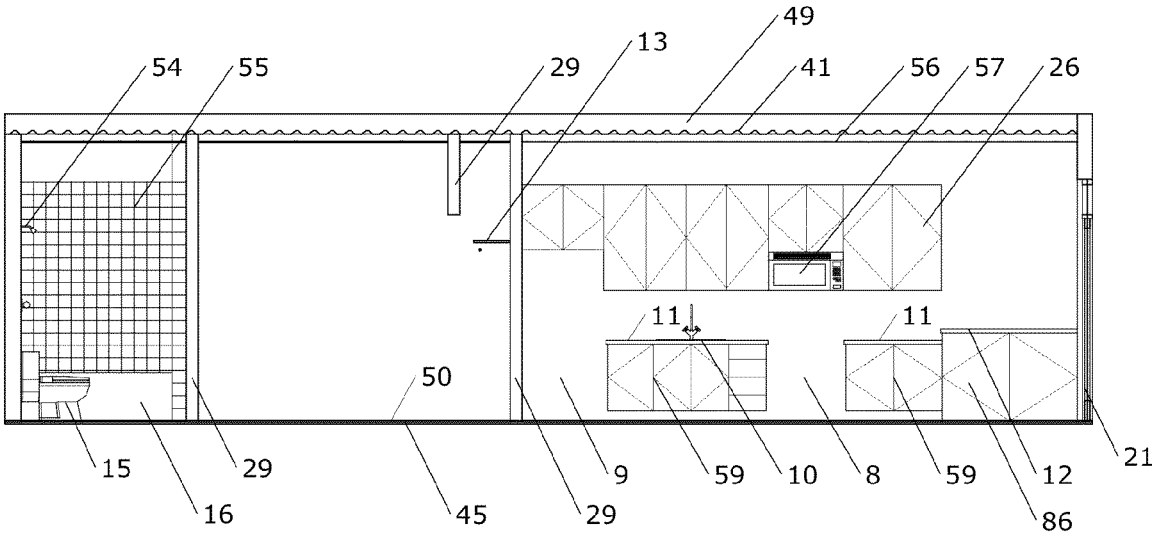
FIG. 9 illustrates a side sectional view through the three bedroom residential unit shown in FIG. 2 as denoted by the section line 32 in accordance with an example embodiment.
Figure 10:
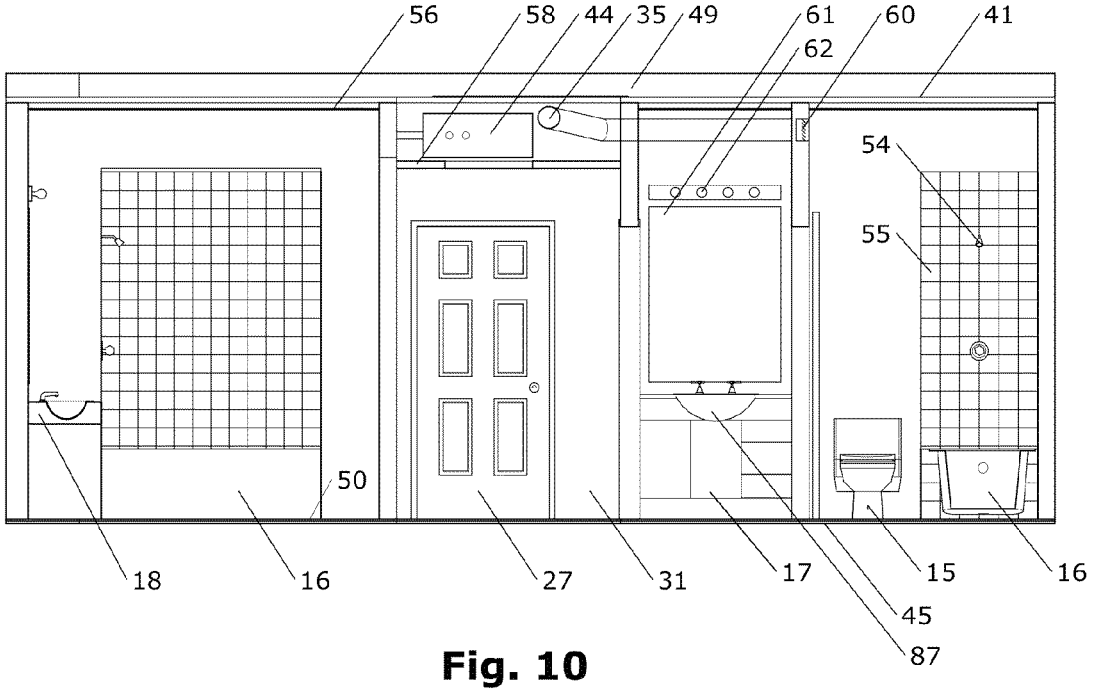
FIG. 10 illustrates a side sectional view through the three bedroom residential unit shown in FIG. 2 showing two bathrooms and the hallway with HVAC distribution in cross section as denoted by the section line 80 in accordance with an example embodiment.
Figure 11:
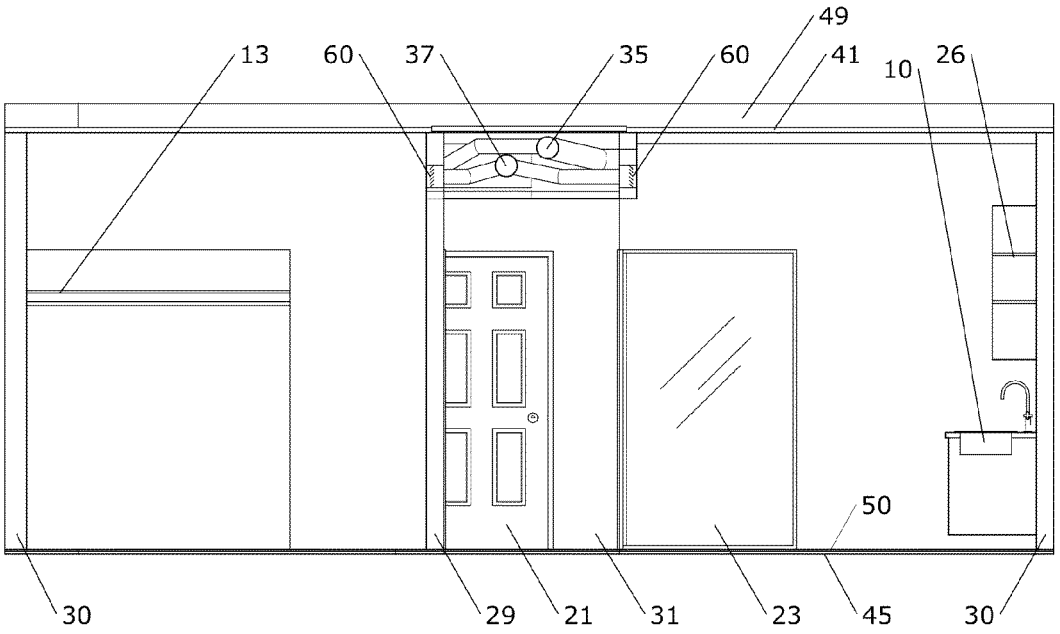
FIG. 11 illustrates a side sectional view through a the three bedroom residential unit shown in FIG. 2 showing one bedroom, the kitchen/living area, and HVAC distribution in cross section as denoted by the section line 81 in accordance with an example embodiment.

FIG. 3, FIG. 4, and FIG. 5 show the same three individual modules in exploded axonometric view with the same subcomponents.

Figure 12:
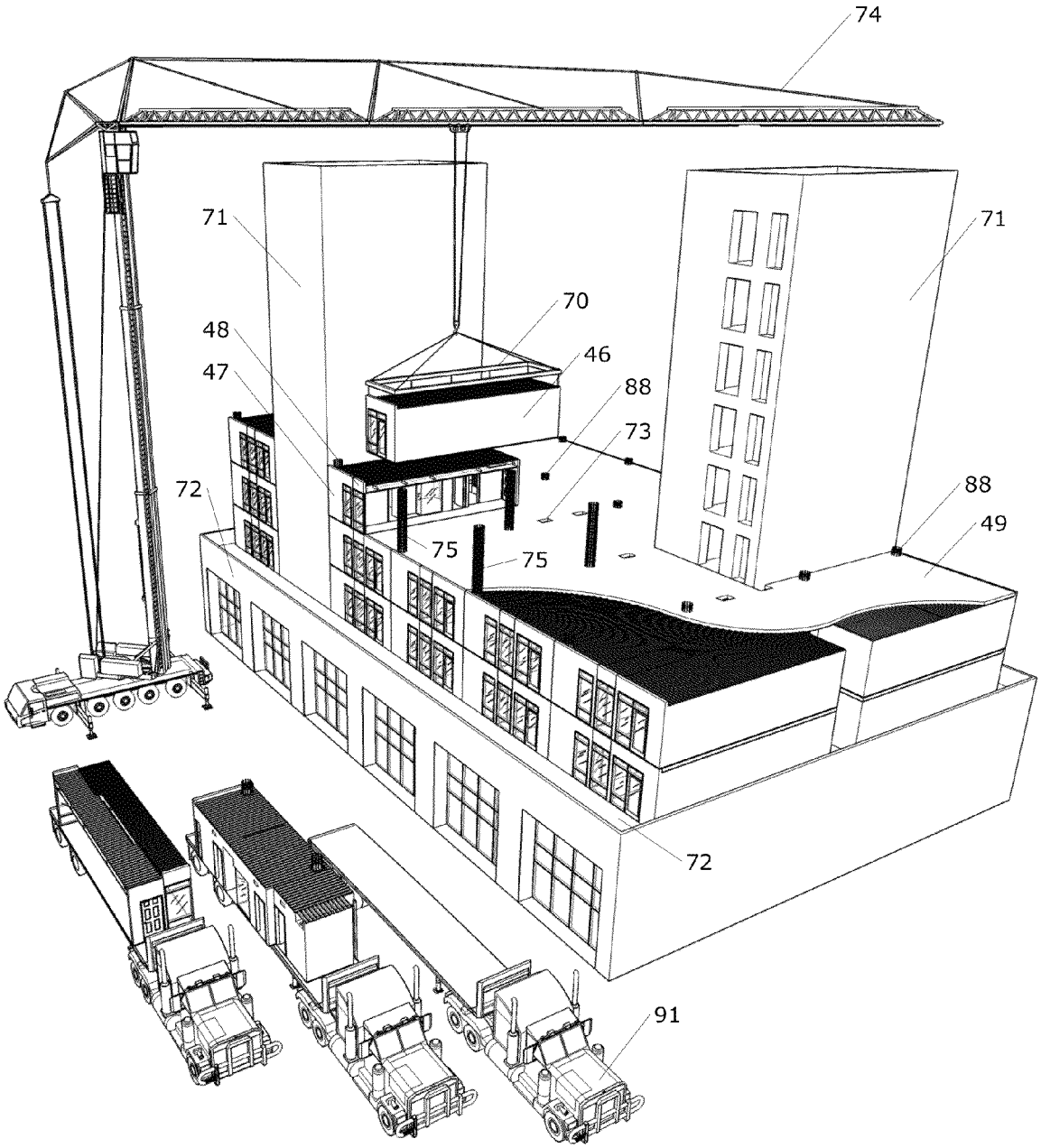
FIG. 12 illustrates a perspective view of the assembly of one possible building using the three modules shown in FIG. 2 in combination with conventional concrete construction in accordance with an example embodiment.

FIG. 12 shows a high rise building under construction using the previously described modules 46, 47, and 48. The building is comprised of an optional conventionally constructed podium level 72 which houses larger-span uses such as retail, parking, or lobbies. Two conventionally formed tower cores 71 rise from the ground level and contain elevators and egress stairs. The remainder of the building is constructed using the invention as shown in FIG. 1, FIG. 2, FIG. 3, FIG. 4, FIG. 5, FIG. 6, FIG. 7, FIG. 8, FIG. 9, FIG. 10, and FIG. 11. First, rebar column cages 75 are spliced onto anchors protruding from the structural deck 49. On higher floors, the column cages 75 are spliced onto the top 88 of column cages 75 below which are left exposed after pouring the structural floor. Modules 46, 47, and 48 are lifted by crane 74 and lifting bracket 70 from their previous transportation 91 to their final location in the building. The column formwork 14 of each module 47 is lined up with each of the column cages 75 which are in-place on the building before the module 47 is lowered to encase them. Electrical, plumbing, and HVAC services from the building are connected to each residential unit at the service shaft 20 of each unit. Once an entire floor is covered with modules, additional lightweight deck 41 is added as necessary to create hallways and other non-modular spaces. Limited additional formwork is installed where necessary to form slab edges at the perimeter and at slab cutouts 73 (which may align with the service shaft 20 of prefabricated modules above or below.) Then the structural bearing material forming the structural deck 49 and columns is poured into the column formwork 14 and over the modules and other decking to create the structural system for the final building, similar to a conventional flat plate concrete structure, structurally tying all modules together and back to the conventionally formed core or cores.

The structural bearing material for the structural deck 49 and the column formwork 14 may be poured at the same time or may be poured separately. Rebar in the structural deck 49 and in the column cages 75 may be tied together with rebar and post tension cables. The column cages 75 may be placed in the column framework 14 at the factory or may be placed in the field.

Mechanical, electrical, and plumbing systems 89 are distributed vertically through the building in shafts created by the service shaft 20 of some prefabricated modules, and the slab cutouts 73. The main distribution systems 89 connect to the preinstalled systems in prefabricated modules at service shaft 20 using conventional connections. The curved boundary of the structural bearing material used to form the structural deck 49 is shown only for illustrative purposes.

The conventional construction in the podium and tower cores may be of concrete, metal, or any other structural bearing system sufficient to accommodate the structural loads of the final building. The structural bearing material poured into column formwork and over the decks may be concrete or any other structural bearing material capable of accommodating the structural loads of the final building. The final result is a building with a conventional structural system of columns and/or walls and structural slabs around the modules 46, 47, and 48, which act as permanent non-structural formwork. The podium level 72 may or may not exist and there may be zero, one, or multiple tower cores 71. The tower cores 71 generally provide lateral bracing for the structure. Note that in some embodiments there may not be a tower core, in which case, cross bracing or shear walls may be employed.

The advantages of the present invention include, without limitation, the ability to build a building of conventional structure and construction materials while completing most of the light construction work in a factory under controlled conditions and with lower labor costs. Countless variations can be made to the modules to accommodate different building uses. The modules must only be engineered to support themselves during transportation and placement/curing. All permanent structural stability is gained from conventional building materials such as concrete and steel. There is no limit on unit or module size like there is when using shipping containers or similar prefabricated units. Module sizes may even exceed standard shipping sizes if there is an area on site that can accommodate a temporary factory for ground level assembly of the modules, or if special transportation arrangements can be made. There is no limit to the height or size of possible buildings due to the invention, since the final result is equivalent to a conventional building. Embodiments of the building may be constructed with only a single story or with only a single module per story. The height limit will be based on the height limits for conventional high rise concrete structures based on the skill of the architectural and engineering team and the zoning codes of the area.

The embodiment shown in FIG. 12 does not show the use of formwork for the exterior walls. However, the structural wall cavity 90, shown in FIG. 1, may be incorporated into the building shown in FIG. 12 in some embodiments. Shear walls and other structural systems are as easily incorporated into the design of a building using the invention as they would be in a conventionally designed building.

In broad embodiment, the present invention is a system of prefabricated building modules which can be combined with conventional construction techniques to yield a final building which is equivalent, but less expensive, faster, and easier to construct than a similarly designed building of conventional construction methods and materials.

The foregoing description of embodiments has been presented for purposes of illustration and description. While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

The invention claimed is:

1. A building comprising:

a plurality of non-bearing prefabricated building units, each having a horizontal upper surface including a horizontal upper exterior surface, and a plurality of vertical non-bearing wall surfaces, wherein some of the plurality of non-bearing prefabricated building units include a plurality of vertically disposed hollow column formwork structures;

a structural deck composed of structural bearing material poured in a liquid state on said horizontal upper exterior surface and using said horizontal upper exterior surface as permanent non-structural formwork; and a plurality of vertically disposed column structural elements each formed by pouring structural material in a liquid state within one of said plurality of vertically disposed hollow column formwork structures, and wherein there are no poured walls such that structural loads in the building are supported substantially by the structural deck and the plurality of vertically disposed column structural elements.

2. The building of claim 1 wherein a second set of one or more of said plurality of non-bearing prefabricated building units are stacked on top of a first set of one or more of said plurality of non-bearing prefabricated building units to form a second level of the building, such that said structural deck is disposed between the first and second sets of prefabricated building units, and the weight of the structural deck and structures above are supported by the plurality of vertically disposed column structural elements and not by the plurality of non-bearing prefabricated building units.

3. The building of claim 2 further comprising additional ones of the plurality of non-bearing prefabricated building units stacked on said first and second sets of non-bearing prefabricated building units to form additional levels of said building.

4. The building of claim 2 further comprising at least one tower core containing elevators and stairs adjacent to some of said plurality of non-bearing prefabricated building units.

5. The building of claim 1 wherein the plurality of vertically disposed hollow column formwork structures in the first and second sets of non-bearing prefabricated building units are aligned to form a single hollow column formwork structure and a structural column is formed within the plurality of vertically disposed hollow column formwork structures of the first and second sets of non-bearing prefabricated building units.

6. The building of claim 1 wherein said plurality of non-bearing prefabricated building units include at least one of: installed floor finish, interior walls, doors, interior glazing, fixtures, cabinetry, plumbing fixtures, fixed appliances, electrical wiring, lighting, water and waste piping, and HVAC equipment.

7. The building of claim 1 wherein some of the plurality of non-bearing prefabricated building units have doorways opening into adjacent non-bearing prefabricated building units, such that a single occupied habitable space unit is created from multiple ones of the plurality of non-bearing prefabricated building units.

8. The building of claim 1 wherein the plurality of non-bearing prefabricated building units include a service shaft with plumbing and electrical components passing therethrough, and connecting to plumbing and electrical components external to said plurality of non-bearing prefabricated building units.

9. The building of claim 1 comprising a base upon which a first story of said plurality of non-bearing prefabricated building units rests.

10. The building of claim 9 wherein said base comprises a podium level building that is not constructed of said plurality of non-bearing prefabricated building units.

11. The building of claim 1 wherein the vertically disposed column structural elements are formed within the plurality of non-bearing prefabricated building units.

12. A building comprising:

a plurality of non-bearing prefabricated modules disposed on multiple levels of said building;

a concrete deck disposed between the plurality of non-bearing prefabricated modules on adjacent levels of said building, wherein the concrete deck is poured in a liquid state on top of the plurality of non-bearing prefabricated modules using a top of the plurality of non-bearing prefabricated modules as permanent non-structural formwork; and vertically disposed column structural elements disposed in openings passing through the plurality of non-bearing prefabricated modules, wherein the vertically disposed column structural elements are poured in a liquid state using the openings as permanent formwork, and wherein there are no poured walls such that structural loads in the building are supported substantially by the concrete deck and the vertically disposed column structural elements.

13. A method of constructing a building comprising:

constructing a plurality of non-bearing prefabricated building units, each having a horizontal upper exterior surface and a plurality of vertical non-bearing wall surfaces, wherein at least some of the plurality of non-bearing prefabricated building units have a plurality of vertically disposed hollow column formwork structures;

lowering a plurality of the non-bearing prefabricated building units onto a pre-existing base at a construction site to create a first story of the building;

applying structural bearing material in a liquid state to fill the plurality of vertically disposed hollow column formwork structures to create vertically disposed column structural elements; and applying structural bearing material in a liquid state to the horizontal upper exterior surfaces of the plurality of non-bearing prefabricated building units to create a single structural deck over the plurality of non-bearing prefabricated building units, and wherein there are no poured walls such that structural loads in the building are supported substantially by the structural deck and the vertically disposed column structural elements.

14. The method of claim 13 further comprising creating a second story of the building by stacking additional ones of the plurality of non-bearing prefabricated building units on top of the structural deck, such that the plurality of vertically disposed hollow column formwork structures in the second story plurality of non-bearing prefabricated building units line up with the plurality of vertically disposed hollow column formwork structures in the first story.

15. The method of claim 14 wherein at least some of plurality of non-bearing prefabricated building units include a service shaft with plumbing and electrical components passing through the service shaft, and wherein said method includes installing and connecting plumbing and electrical components in the service shaft.

16. The method of claim 13 further comprising:

constructing column cages in the locations where the plurality of vertically disposed hollow column formwork structures will be located; and wherein the step of lowering comprises lowering the plurality of non-bearing prefabricated units such that the column cages fit inside the plurality of vertically disposed hollow column formwork structures.

17. The method of claim 16 further comprising adding second story column cages to the existing column cages on the first story prior to the step of stacking additional ones of the plurality of non-bearing prefabricated building units on top of the plurality of non-bearing prefabricated building units on the base.

18. A method of constructing a building comprising:

arranging a plurality of non-bearing prefabricated modules disposed on a first level of said building, at least some of the plurality of non-bearing prefabricated modules having vertically disposed hollow column formwork structures;

pouring a concrete deck on top of the plurality of non-bearing prefabricated modules on the first level using the top of the plurality of non-bearing prefabricated modules on the first level as permanent non-structural formwork, the concrete also filling the vertically disposed hollow column formwork structures and forming column structural elements; and arranging a second level of the plurality of non-bearing prefabricated modules on top of the concrete deck, and wherein there are no poured walls such that structural loads in the building are supported substantially by the concrete deck and the column structural elements.

19. The method of claim 18 further comprising:

creating additional levels of said building by repeating the steps of arranging and pouring for said additional building levels.

* * * * *